United States Patent [19]

Rockwell

[11] 4,030,553

[45] June 21, 1977

[54] PERCUSSION TOOL WITH NOISE REDUCING CHARACTERISTICS AND METHOD OF MAKING

[76] Inventor: Thomas H. Rockwell, 11801 Summers Road, Chesterland, Ohio 44026

[22] Filed: June 23, 1975

[21] Appl. No.: 589,022

[52] U.S. Cl. ..... 173/1; 173/162; 173/DIG. 2; 181/33 A; 181/36 A

[51] Int. Cl.[2] ..... B25D 17/12; B25D 17/24

[58] Field of Search ..... 175/56; 173/162, DIG. 2, 173/1, 139; 181/33 A, 36 A; 403/361, 306, 300, 305, 341

[56] References Cited

UNITED STATES PATENTS

| | | | |
|---|---|---|---|
| 1,073,614 | 9/1913 | McDearmid | 403/306 X |
| 2,161,062 | 6/1939 | Killgore | 299/94 |
| 2,680,333 | 6/1954 | Calosi | 175/56 X |
| 2,989,130 | 6/1961 | Mathewson, Jr. et al. | 175/56 |
| 3,027,953 | 4/1962 | Coski | 403/361 X |
| 3,094,176 | 6/1963 | Cook | 175/92 |
| 3,239,233 | 3/1966 | Stillwagon, Jr. | 403/361 X |
| 3,263,446 | 8/1966 | Wiggins, Jr. | 175/320 X |
| 3,344,874 | 10/1967 | Bodine | 175/56 |
| 3,815,691 | 6/1974 | Richter | 175/56 |
| 3,856,107 | 12/1974 | Rabett | 173/DIG. 2 |

*Primary Examiner*—Ernest R. Purser
*Assistant Examiner*—William F. Pate, III

[57] ABSTRACT

A method of modifying a percussion tool to provide noise reduction, and a percussion tool having effective noise damping characteristics.

In the method of the present invention, a troublesome noise frequency radiated by the tool is identified, and a resonant bending mode shape for the tool is determined, which bending mode shape corresponds to the identified noise frequency. The tool is then assembled and a structural discontinuity is introduced at a point along the length of the tool which is a predetermined axial distance from a selected antinode of the bending mode shape to provide an impedance mismatch at that point.

The tool, which is of predetermined length, is formed of one or more sections, each of which is of a selected length. The lengths of the sections are carefully determined such that when the tool is in assembled condition, impedance mismatches are provided at selected points along the length of the tool, to provide noise reduction of several troublesome noise frequencies.

13 Claims, 13 Drawing Figures

APPROXIMATE SHAPES OF THE FIRST THREE SIMPLY-SUPPORTED AND FREE-FREE BENDING MODES. THE CUT LINES SHOW THE LOCATIONS OF THE THREADED JOINTS RELATIVE TO THE MODE SHAPES.

EFFECT OF MUFFLER ON CHIPPING HAMMER NOISE.

APPROXIMATE SHAPES OF THE FIRST THREE SIMPLY-SUPPORTED AND FREE-FREE BENDING MODES. THE CUT LINES SHOW THE LOCATIONS OF THE THREADED JOINTS RELATIVE TO THE MODE SHAPES.

RESONANCE OF THE DAMPED AND UNDAMPED CHISELS

RESONANCE FREQUENCIES OF THE CHISEL WHEN SUSPENDED AS A FREE-FREE BODY AND IMPACTED BOTH LONGITUDINALLY AND TRANSVERSELY

THE DAMPED CHISEL PLUS THE MUFFLER RESULTED IN A 12 dB REDUCTION IN CHIPPING NOISE.

PERCUSSION TOOL WITH NOISE REDUCING CHARACTERISTICS AND METHOD OF MAKING

BACKGROUND OF THE INVENTION

This application relates to percussion tools of the type which utilize chisel-like bits such as rock drills, paving breakers, chipping hammers and the like. More particularly, the present application relates to the reduction of noise in such types of tools.

Foundry cleaning rooms are extremely noisy places. For example, during periods where a pneumatic hammer and chisel are used to remove sprues, gates, risers and burrs from castings, the noise level in the foundry cleaning room often exceeds 110 dBA, to which OSHA requirements limit employee exposure to 30 minutes a day or less.

Two major noise sources include the pneumatic exhaust from the hammer, and ringing of the casting. Mufflers have been found to be effective in reducing noise due to pneumatic exhaust of the hammer, and sand beds or special holding jigs have had some degree of success in dumping casting ringing.

Applicant has determined that a third major noise source includes the "ringing" of the chisel itself. In addition to the applicant, this potential noise problem has been recognized in an article in the Jan. 1959 edition of "Noise Control" magazine and in U.S. Pat. No. 3,662,855. In the "Noise Control" article a proposed solution to chisel ringing comtemplates construction of the entire chisel of a non-metallic material with a fairly high internal damping characteristic. In particular, the author notes that a chisel made of nylon was preferred. In U.S. Pat. 3,662,855, the patentees disclose mounting of a collar of vibration damping material around the tool body for reducing or muffling tool noise, and further indicate that the collar should be located at least around the point of maximum lateral amplitude of the tool body during operation of the machine.

SUMMARY OF THE PRESENT INVENTION

According to the present invention, there is provided a method of modifying a percussion tool which is believed to be extremely effective at reducing the noise due to the "ringing" of the tool, while adding no significant increase in weight to the tool. Moreover, the method of the present invention is believed to be applicable to numerous forms of percussion tools in addition to chipping hammers. An additional advantage of the present invention is that it does not peel off with repeated impacts, as a coating might tend to do.

There is further provided, according to the invention, a percussion tool construction, which construction has extremely efficient noise reducing capabilities.

Briefly, in the method of the present invention, a troublesome noise frequency radiated by the tool is identified, and a resonant bending mode shape for the tool is determined, which bending mode shape corresponds to the identified noise frequency. The tool is then assembled and a structural discontinuity is introduced at a point along the length of the tool which is a predetermined axial distance from a selected antinode of the bending mode shape to provide an impedance mismatch at that point.

Preferably, the tool, which is of predetermined length, is formed of two or more sections, each of which is of a selected length. The lengths of the sections are carefully determined such that when the tool is in assembled condition, impedance mismatches are provided at selected points along the length of the tool, to provide noise reduction of several troublesome noise frequencies. In one preferred embodiment, the impedance mismatches are introduced at points one-third the length of the tool, and in a second preferred embodiment impedance mismatches are introduced at the midpoint of the tool and at a point which is spaced from an end of the tool by a distance which is one-fourth the length of the tool.

Other objects and advantages of the present invention will become further apparent from the following specifications and the accompanying drawings wherein:

DETAILED DESCRIPTION OF THE PREFERRED EMBODIMENT

Figure 1:
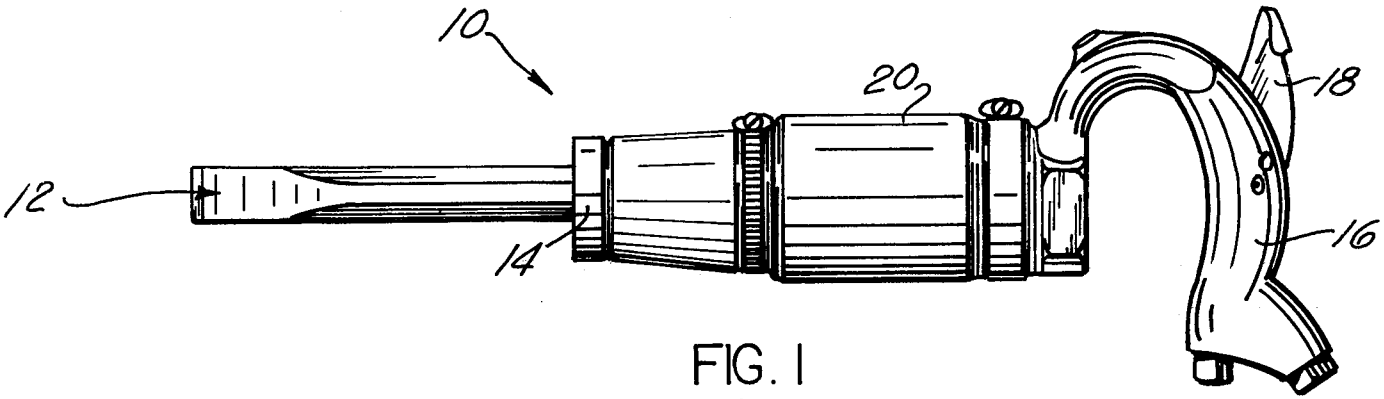
FIG. 1 is a perspective side view of a pneumatic chipping hammer.

As stated above, the present invention relates to the reduction of noise in percussion tools. For purpose of illustrating the principles of the present invention, there is disclosed hereinafter the manner in which the present invention has been applied to a pneumatic chipping hammer. However, it is contemplated that the manner in which the present invention may be similarly applied to numerous comparable type devices such as rock drills, paving breakers, and the like, will become readily apparent to those of ordinary skill in the art from the description which follows. Referring now to FIG. 1, there is disclosed a chipping hammer 10 comprising an axially extending chisel tool 12 axially slidable in a bearing support (not shown) in a housing 14. There is provided a handle 16 which is grasped by a operator and a trigger 18 by which an operator can actuate a conventional pneumatic hammer for longitudinally impacting the tool 12. As is conventional in this field, a muffler 20 may be provided for reducing the effect of exhaust noise.

Figure 2:
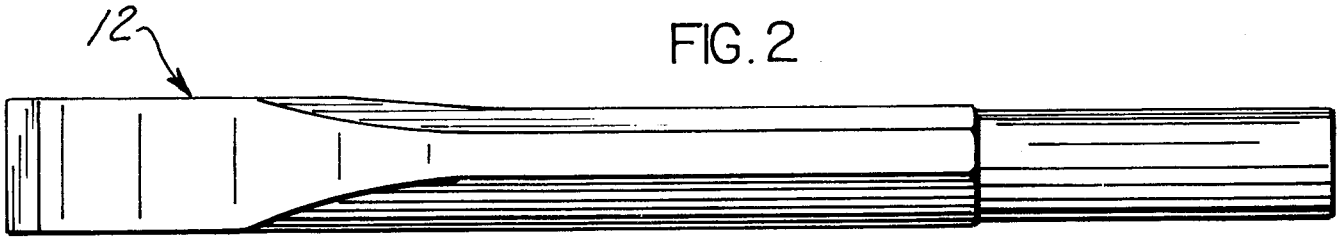
FIG. 2 is an enlarged perspective view of a chisel of the type which is employed with a chipping hammer such as that shown in FIG. 1.
Figure 9:
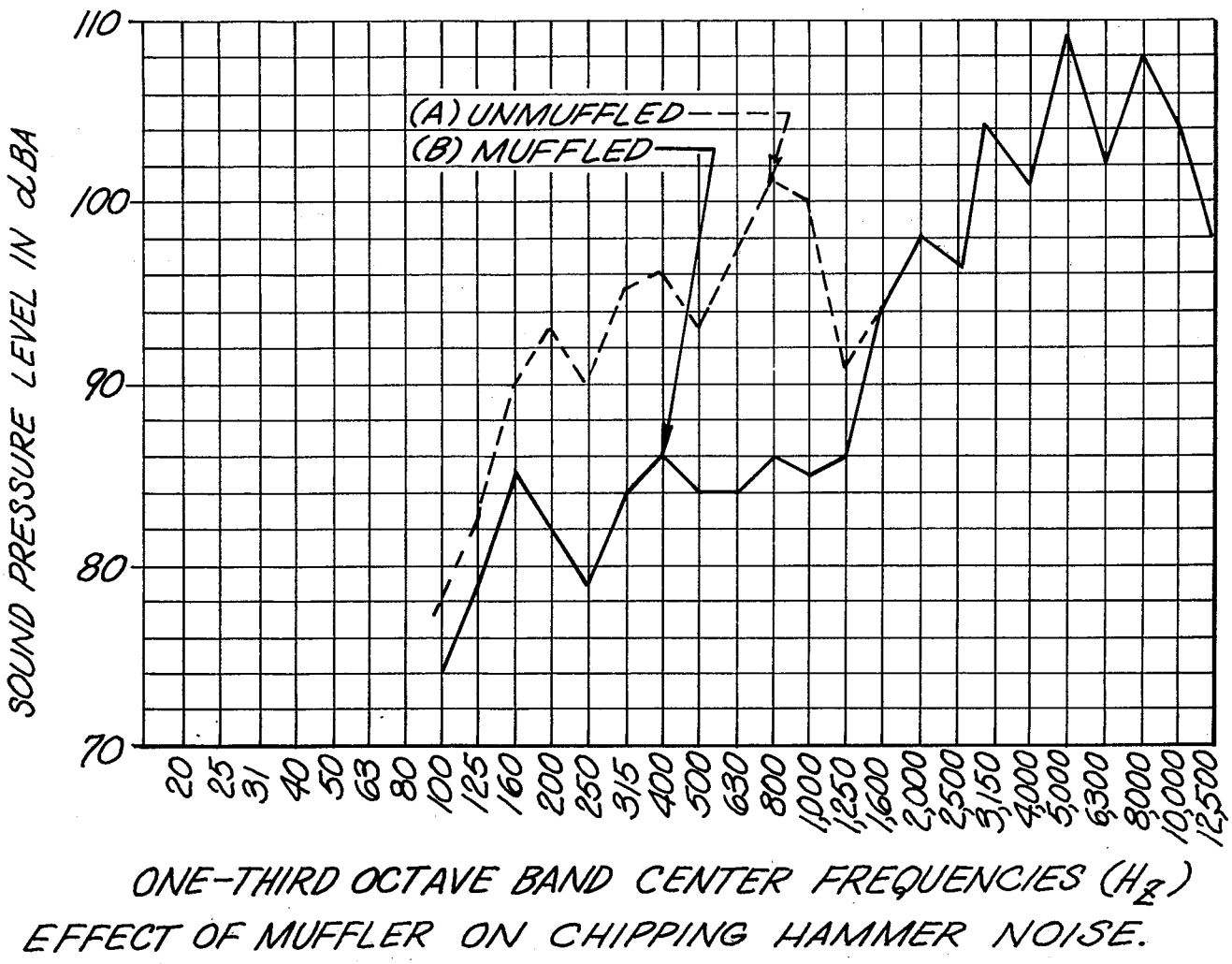
FIG. 9 is a graph illustrating the effect of a muffler on chipping hammer noise.

FIG. 9 illustrates a measured sample of the noise produced by a chipping operation using a tool such as shown in 10 in FIG. 1 and employing a chisel such as shown in 12 in FIGS. 1 and 2. The data was obtained at a distance of 18 inches from a pneumatic chipping hammer in which an 8-182 inch chisel was supported. The chipping operation was performed against a steel block (12 × 4 × 3) which was placed in a bed of sand to help reduce the tendency of the block to ring. Therefore, the data of FIG. 9 is due primarily to the hammer and chisel combination itself. In the discussion which follows, the data referred to as taken under operating conditions refers to data taken under similar conditions.

Also, for reference purposes, the data was obtained by using a portable sound level meter having one-third--octave band analysis capabilities. In the samples referenced in FIG. 9, the amplitude in each filter band has been plotted against the conventional "A" weighting curve in order to emphasize the relative significance of the spectral energy distribution for OSHA compliance.

According to the present invention, the troublesome noise frequencies of the tool are first identified. Referring again to FIG. 9, the heavy line "B" illustrates the contribution of the muffler in overall noise damping. FIG. 9 also illustrates several peaks at 2,000 Hz, 3,150 Hz, 5,000 Hz and 8,000 Hz which are not affected by the muffler. These are noise frequencies which are reduced by the method embodied in the subject invention.

A resonant, bending mode shape for the tool is then determined. Longitudinal resonance frequencies for the tool were determined and were found to be above the range of concern. According to the preferred embodiment, it was found that for a chisel of the general size and shape of that disclosed in FIG. 1, the chisel resonant frequencies whithin the range of concern, and which is disclosed in FIG. 9, are closely approximated by those of a transversely vibrating free-free or simply supported beam.

In arriving at the latter determination, it was recognized that for a tool whose principal resonant frequencies approximate those of a beam in bending, that the resonant frequencies can vary as a function of the end or boundary conditions, as a function of the beam length, as a function of the beam diameter, and as a function of the beam material. For beam whose length approximates 8-¾ inches, whose diameter approximates ¾ inches and which was made of hardened tool steel, the frequencies of the first three resonant modes for each of the potential end conditions were computed and tabulated as shown below:

TABLE I

| Boundary Conditions | Mode No. 1 | Mode No. 2 | Mode No. 3 |
|---|---|---|---|
| Simply Supported | 820 | 3240 | 7240 |
| Cantilever | 288 | 1900 | 5040 |
| Free-Free; clamped-clamped | 1900 | 5040 | 9900 |
| Clamped-hinged; hinged-free | 1260 | 4100 | 8500 |

The underlined frequencies are those which compare well with those peaks which were measured and shown by FIG. 9, suggesting that the boundary conditions that give rise to the troublesome resonant frequencies are a combination of simply supported and free-free.

Figure 12:
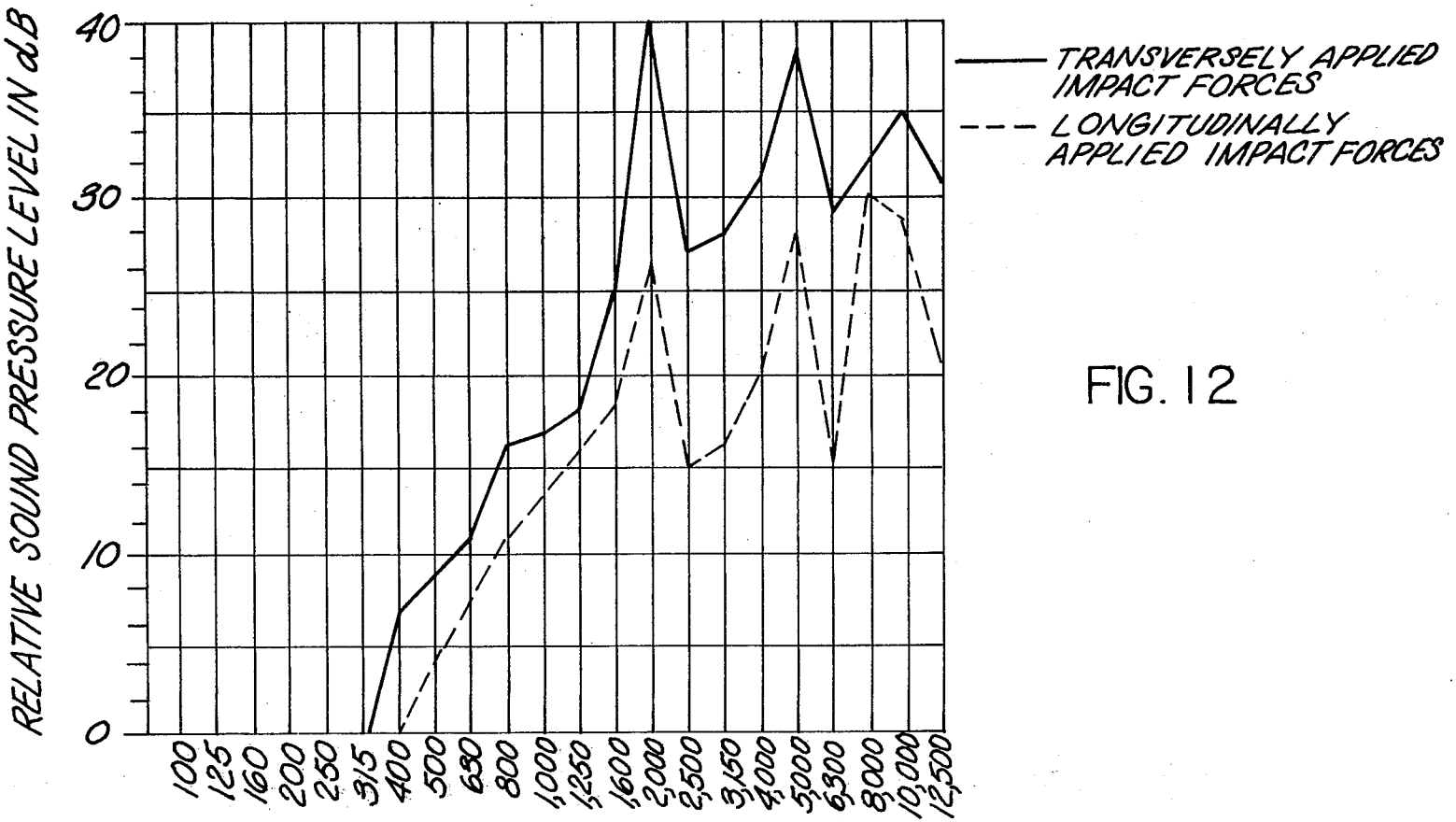
FIG. 12 illustrates the corresponding noise frequencies from bending modes of a free-free undamped tool when either transverse or longitudinal impact forces are applied to the tool shank.

Therefore, as shown by the above table and by FIG. 9, it is clear that the resonant frequencies actually detected are reasonably well approximated by the resonant frequencies for simply supported and free-free beams vibrating within their first three bending modes. This approximation was further supported by the data shown in FIG. 12. A chisel suspended as a free-free body showed corresponding resonance peaks (within tolerable limits) when impacted both transversely and longitudinally, thus confirming at least relative accuracy of the computed frequencies.

Thus, according to the disclosed embodiment, the bending mode shapes for the tool are determined by using a free-free or simply suported beam as a model.

Figure 10:
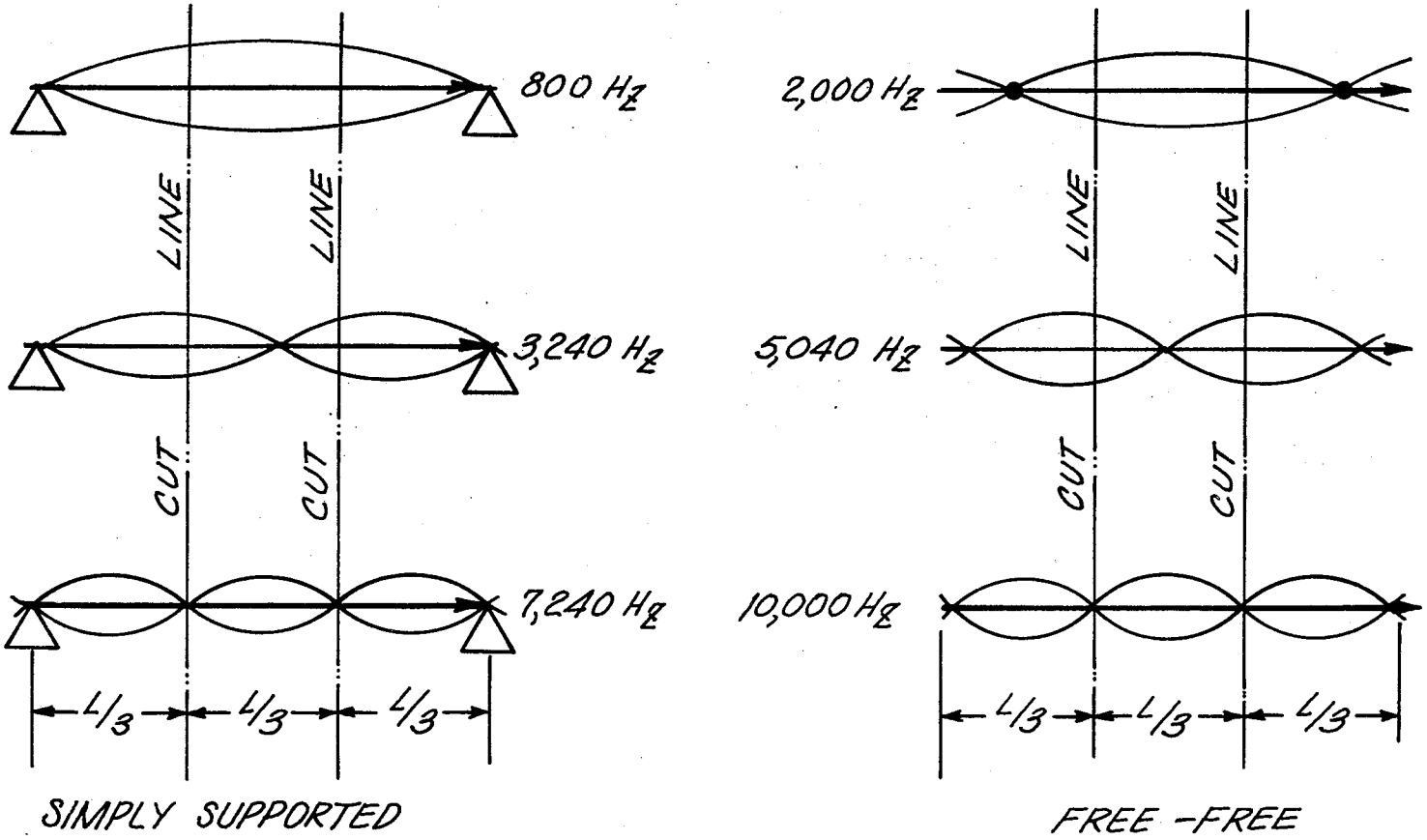
FIG. 10 illustrates the bending mode diagrams for simply supported and free-free beams.

FIG. 10 illustrates the first three bending mode shapes for both a simply supported beam and for a free-free beam. Although the frequencies may change as a function of beam material and beam dimensions, the mode shapes will remain unchanged. The frequencies attached to the mode shapes shown in FIG. 10 are the specific frequencies calculated in Table I and measured in FIG. 9.

These diagrams depict the relative amplitudes of resonant vibrational motion along the length of the beam for each of the first three resonant bending modes corresponding to simply supported and free-free boundary conditions. For example, in the diagram of the third resonant mode of a simply supported beam, minimum vibrational motion occurs at nodes located at the beam end points and at the L/hd 3 and 2L/hd 3 points, where L is the length of the beam as measured from the shank end of the tool as in FIG. 3. For the same mode, maximum motion occurs at antinodes located at the points $L/_6$, $L/_2$, and $5L/_6$.

According to the present invention, the vibration amplitude of any given mode is reduced by introducing an impedance mismatch at a predetermined point along the tool which point is a selected distance from the location of an anti-node for that mode. Ideally, in each of the beam bending modes, it would be desirable to introduce an impedance mismatch precisely at an anti-node of each mode for which noise reduction is desired. However, it is also obvious from FIG. 10 that an impedance mismatch precisely located a selected distance from a selected antinode will substantially reduce noise from a selected mode and will have the additional benefit of reducing all modes having antinodes at that same location and contributing some noise reducing characteristics to all modes not having nodes at that location. For example, an impedance mismatch located at the mid-point $L/_2$ of the beam, should cause vibration reduction of modes No. 1 and No 3 for both the simply supported and free-free beam end conditions. Conversely, as may also be seen from FIG. 10, an impedance mismatch located at $L/_2$ would provide little or no noise reduction of either of the No. 2 modes.

In a similar manner it becomes clear from FIG. 10 that an impedance mismatch located at $L/_4$ or $3L/_4$ would be expected to provide strong reduction of the resonant vibrations of both third modes, and also provide significant reduction of the first modes and second modes.

Thus, by determining the resonant mode shapes of a vibrating beam in bending which approximates the vibration of the tool, and by judicious location of points of impedance mismatch, it is possible to selectively reduce the noise radiated by bending resonances of the tool; e.g., all modes should be strongly reduced by impedance mismatches located at $L/_4$ and L/hd 2; all but the third modes should be significantly reduced by impedance mismatches located at $L/_3$ and $2L/_3$; etc.

According to a particular feature of the present invention, it has been found that an effective manner of providing impedance mismatches and of reducing noise without causing an appreciable increase in weight or bulkiness of the tool is to form the tool of several sections of selected length. The several sections are joined to each other in such a manner that structural discontinuities are provided at the selected points along the length of the tool.

In the preferred embodiment a tool is first formed as a single member of predetermined length. The tool is then transversely cut at selected points, forming two or more sections. The tool is then reassembled either with the original sections with appropriate machining, where necessary, or one or more of the sections is replaced by a newly constructed section of such a length that when joined the reassembled tool length is substantially equal to the original predetermined length of the tool. Reconstructing the tool in this manner introduces impedance mismatches at the junctions of the sections. It is also contemplated that the tool may be formed by initially constructing the desired number of sections, each being of selected length, and then assembling the sections.

In a first preferrred embodiment, impedance mismatches at the $L/_3$ and $2L/_3$ points (FIG. 3) have the effect of reducing the first two bending modes. In a second preferred embodiment, impedance mismatches located at $L/_2$ and $L/_4$ (FIGS. 4 and 5) would have the effect of reducing all six modes described in FIG. 10.

Figure 3:
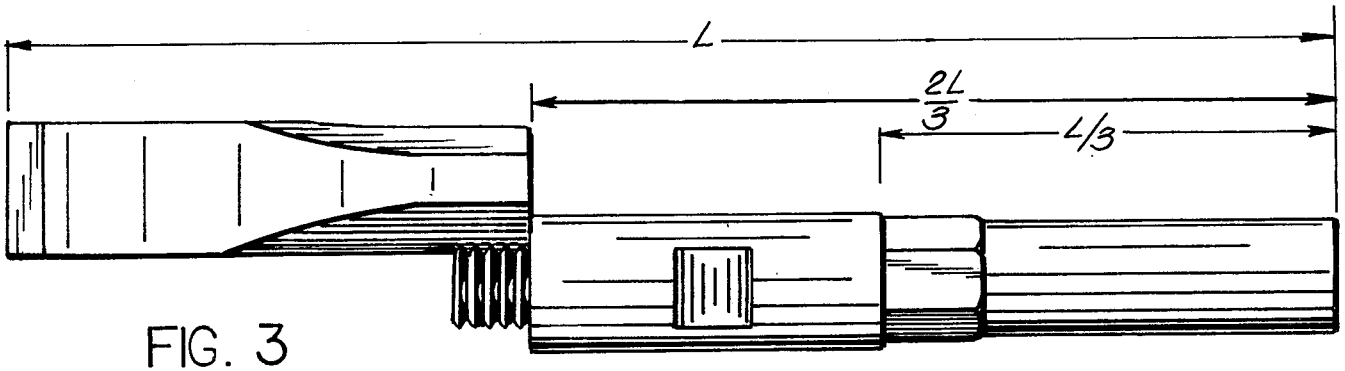
FIG. 3 is a perspective view of a tool which has been modified according to the present invention, with the lower portion shown in an exploded view.
Figure 4:
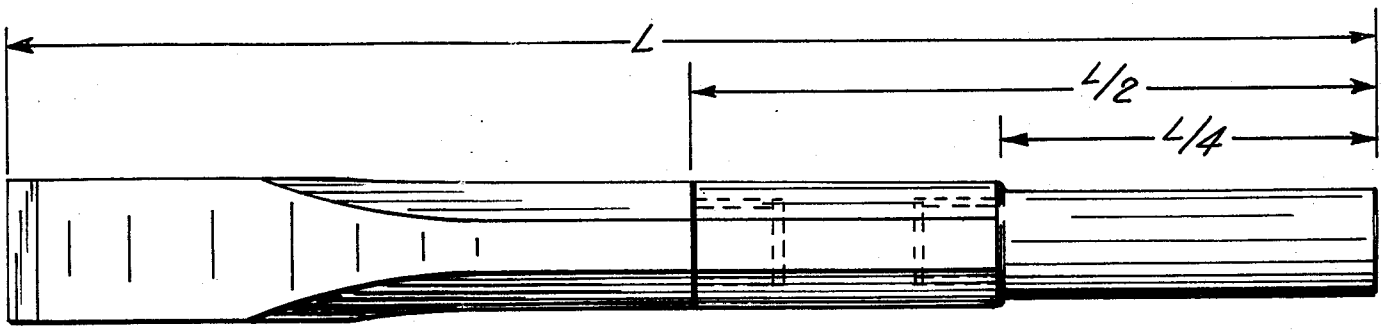
FIG. 4 is a perspective view of a tool modified in accordance with the present invention and illustrating schematically the tool in assembled condition.
Figure 5:
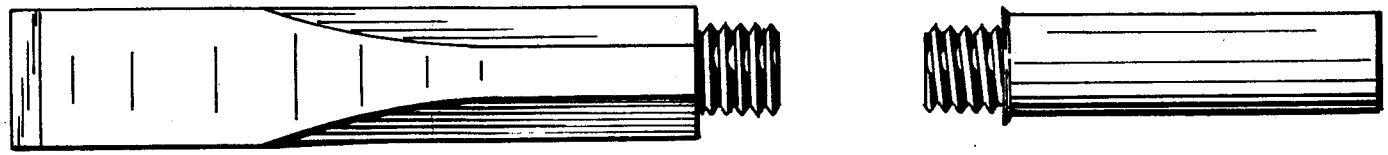
FIG. 5 is an exploded view of the tool of FIG. 4.
Figure 5:
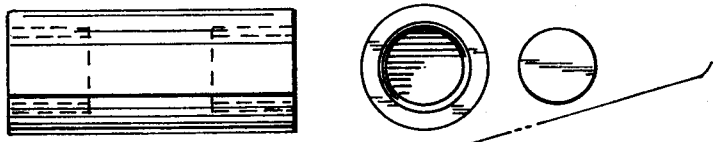

In the first preferred embodiment, the tool is formed as a three-piece member with all three sections of hardened tool steel. The sections are joined to each other by threaded portions with the threaded portions of the middle section extending outwardly from its ends (as shown in FIG. 3) or inwardly from its ends (as shown in FIGS. 4 and 5).

Figure 6:
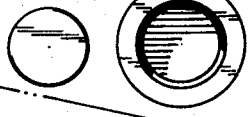
FIGS. 6, 7 and 8 disclose various modified forms of providing impedance mismatches in a percussion tool.
Figure 6:
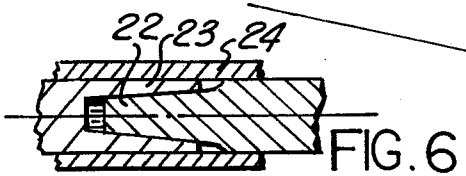
Figure 8:
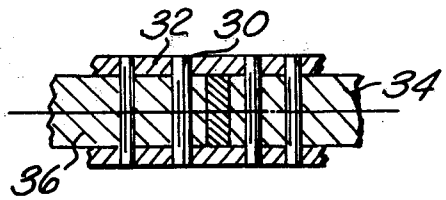
Figure 7:
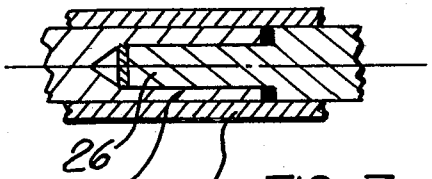
Figure 11:
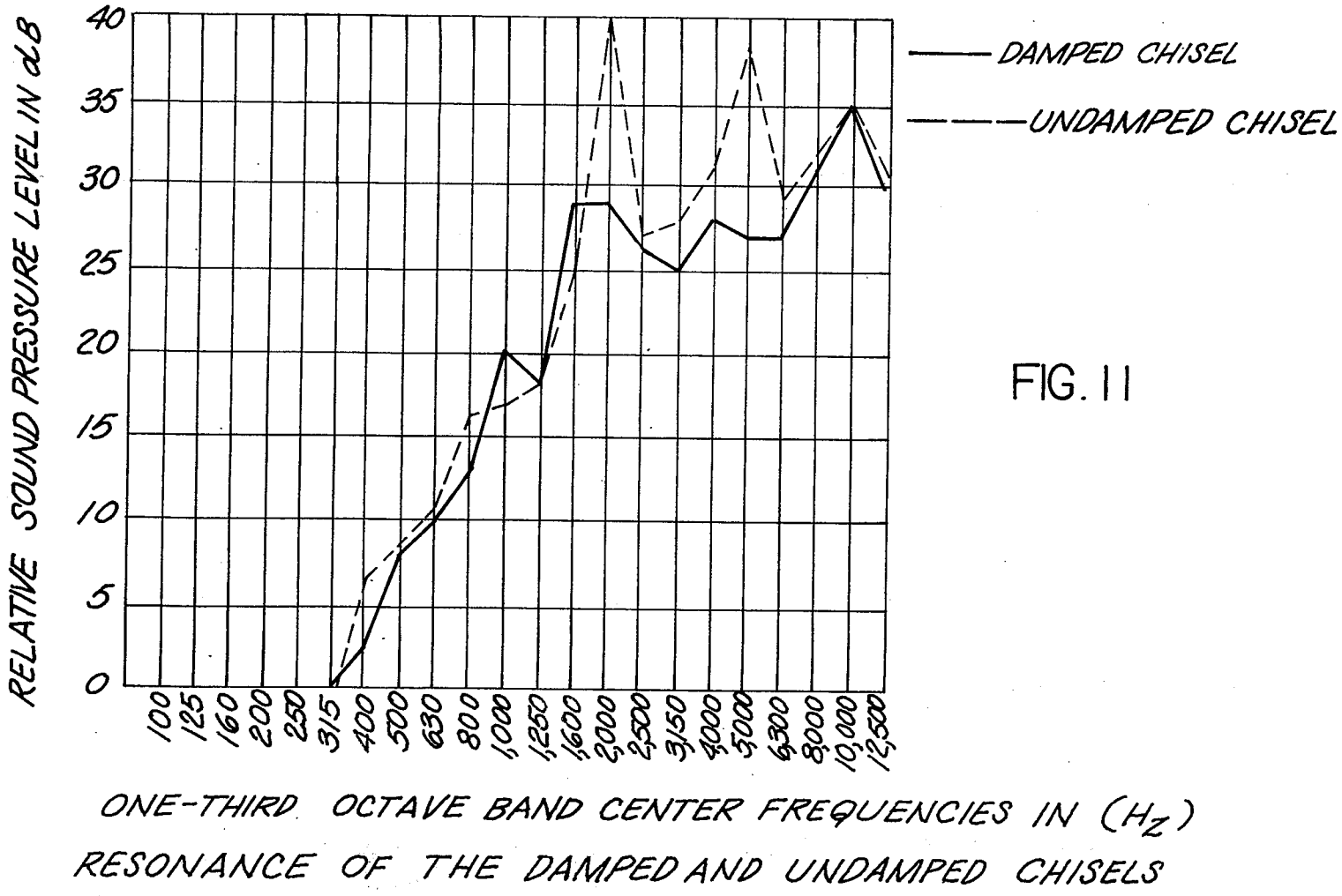
FIG. 11 illustrates the relative amplitudes of the noise produced at resonant frequencies of a free-free undamped tool and for a free-free tool where the chisel has been modified in accordance with the present invention.
Figure 13:
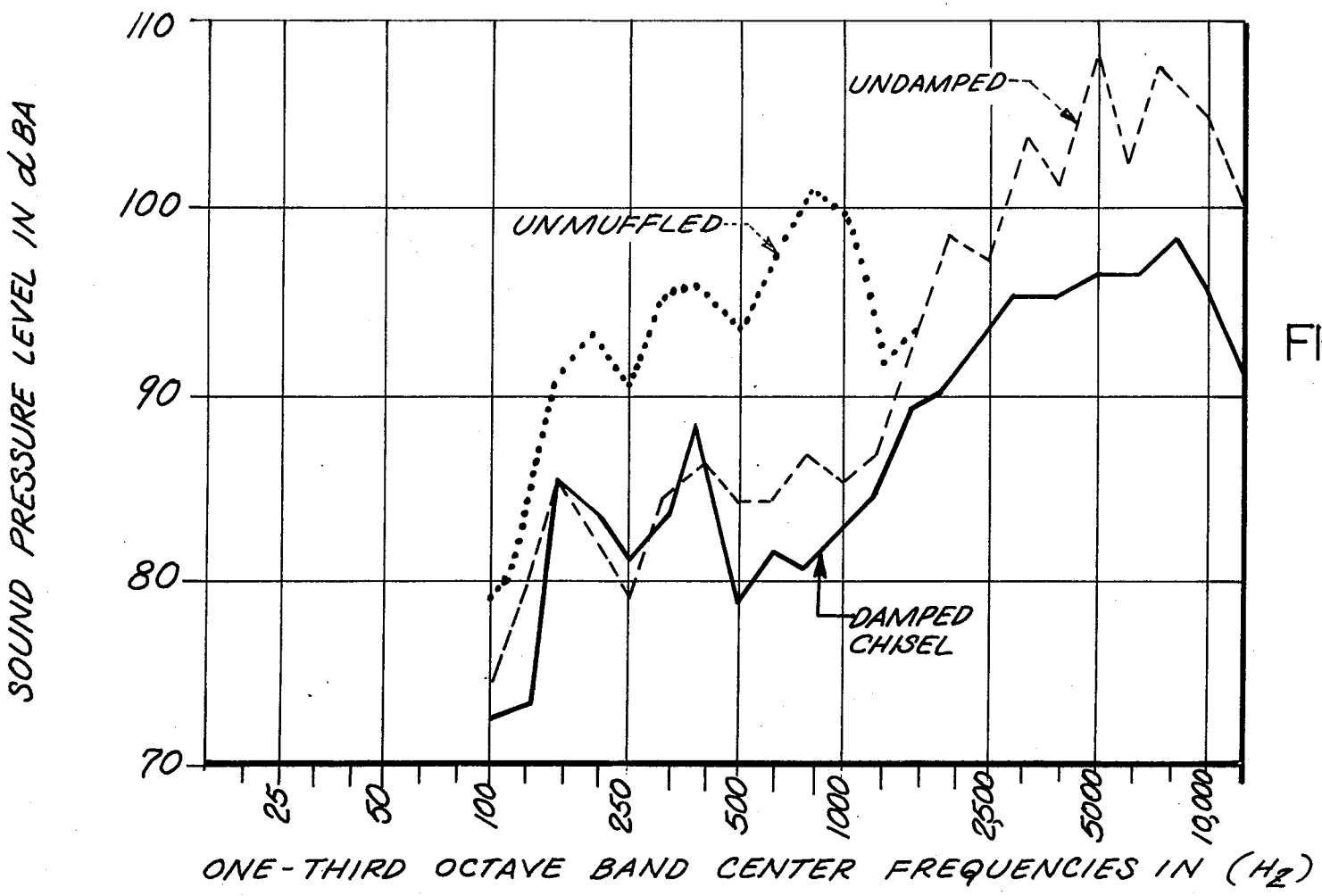
FIG. 13 compares the measured frequencies during actual operating conditions of a tool without any noise reducing characteristics, a tool with a muffler and a tool constructed according to the invention.

Further alternatives for creating the impedance mismatches are shown in FIGS. 6, 7, and 8. FIG. 6 shows a pair of forcefitted conical sections 22, 23 which are encircled in a sleeve 24. FIG. 7 shows a pin 26 and slot 27 surrounded by sleeve 28 and the parts are shrink-fitted to join them. FIG. 8 shows pins 30 which interconnect sleeve 32 with the tool sections 34, 36. In the embodiments of FIGS. 6, 7, and 8 the outer sleeve itself does not materially contribute to the impedance mismatch but rather serves to hold the parts in assembled relationship FIG. 11 illustrates the noise reduction exhibited by a chisel constructed in accordance with the present invention, and with structural discontinuities at the $L/_3$ and $2L/_3$ points (FIG. 3), and supported as a free-free tool. As expected, the peaks at 2,000 Hz and 5,000 Hz were substantially eliminated, whereas a peake at about 8,000 Hz remained. Referring to FIG. 13, there is illustrated the noise reduction effects of a similar tool in actual use.

By virtue of the foregoing disclosure, it will be apparent to those of ordinary skill in the art that for a chisel or similar impacting tool, the tool can be modified in order to substantially reduce "ringing noise" by identifying a troublesome noise frequency radiated by the tool determining a resonant bending mode shape for the tool which corresponds to the identified frequency, and providing a structural discontinuity at a point along the length of the tool which is a predetermined axial distance from a selected antinode of the bending mode to provide noise reduction.

It will be recognized by those of ordinary skill in the art that for percussion tools other than the above described chipping hammer, the determination of beam boundary conditions which approximate the tool ringing may suggest boundary conditions other than those for the chipping hammer. Those boundary conditions can be identified and appropriate bending mode shapes determined, and impedance mismatches introduced at appropriate points along the tool length in accordance with the principles of the present invention.

Moreover, with the foregoing disclosure in mind, many other and varied modifications of the present invention will become readily apparent to those of ordinary skill in the art.

Therefore, what is claimed is:

1. A method of constructing a longitudinally extending percussion tool of predetermined length for use in combination with an apparatus having means for delivering longitudinally directed impacts to an impact receiving portion of the tool, said method comprising the steps of:

a. operating a longitudinally extending monolithic prototype percussion tool of said predetermined length having an impact receiving portion and a working end portion by impacting the tool to generate the resonant audible noise frequencies radiated by the prototype tool during use;

b. identifying a resonant audible noise frequency radiated over the length of the prototype tool during operation;

c. establishing a mode shape for the longitudinally extending percussion tool by determining the resonant mode shape for the prototype tool which corresponds to the frequency identified in step (b);

d. providing a plurality of tool sections, each of predetermined length and which when joined to each other form a tool having an impact receiving portion and a working end portion and having a length equal to the length of the monolithic prototype tool and a strutural discontinuity at at least one predetermined location along the length of the tool, which location is a predetermined longitudinal distance from an antinode of the mode shape established for said longitudinally extending percussion tool to introduce an impedence mismatch at that location, and joining the plurality of tool sections to each other to form a percussion tool; and e. providing said impact receiving portion in a configuration and at a location relative to the length of the tool that the tool is combinable with an apparatus having means for impacting the impact receiving portion of the tool with the impact receiving portion of the tool disposed for engagement with the impacting means.

2. A method as set forth by claim 1 further including the steps of identifying the resonant audible noise frequencies radiated over the length of the monolithic prototype tools and establishing bending mode shapes for the longitudinally extending percussion tool by determining the resonant bending mode shapes which correspond to the resonant noise frequencies identified in connection with the monolithic prototype tool, and providing a plurality of tool sections of perdetermined length which are joined to each other to provide a longitudinally extending percussion tool of said predetermined length with structural discontinuities at locations along the length of the tool which are each a predetermined longitudinal distance from the antinodes of the bending modes established for said longitudinally extending percussion tool to introduce impedance mismatches at those points.

3. For use in combination with an apparatus having means for longitudinally impacting an impact receiving portion of a percussion tool, a longitudinally extending percussion tool of a predetermined length, said longitudinally extending percussion tool including means defining an impact surface for receiving longitudinally directed impacted forces from an impacting means, longitudinally impacting a working end portion of the tool against an object, said longitudinally extending tool having a predetermined bending mode shape which corresponds to the bending mode shape of an audible resonant frequency radiated during use by a monolithic prototype percussion tool of said predetermined length, said longitudinally extending percussion tool comprising a plurality of longitudinally extending tool sections one of which includes said impact receiving portion and another of which includes said working end portion, means for joining the longitudinally extending tool sections to each other to form said longitudinally extending tool in a length equal in length to the monolithic prototype percussion tool and with an impedance mismatch at a point along the length of the tool which is a predetermined longitudinal distance from a selected antinode of said bending mode shape.

4. A longitudinally extending percussion tool as defined in claim 3, wherein said tool comprises three tool sections, a first tool section of selected length which includes a working end portion, a second tool section of selected length which includes said impact receiving surface, and a third section of selected length having first and second ends, means for joining a first end of said third section to an end of said second section and for joining a second end of said third end section to an end of said first section for forming a tool of predetermined length L equal to the length of said monolithic tool and with impedence mismatches at the L/3 and 2L/3 points along the length of the tool.

5. A percussion tool as set forth by claim 4 wherein each end of said third section includes a threaded portion, and the respective ends of said first and second sections to which the ends of said third section are joined include threaded portions.

6. A percussion tool as set forth in claim 4 wherein each end of said third section comprises a conically shaped portion, and the end of each of said first and second sections which is joined to said third section includes a conically shaped portion which is dimensioned to interfit with a respective end of said third portion and to provide an interference fit therewith

7. A percussion tool as set forth in claim 4 wherein each end of said third section includes a pin, and one end of eacch of said first and second section includes a slot for receiving a respective pin, each associated pin and slot being in shrink fitted engagement.

8. A percussion tool as set forth in claim 4 wherein there is provided a first sleeve surrounding the first end of said third section and an end of said first section, means for joining said first end of said third section to said sleeve and for joining said end of said first section to said sleeve, a second sleeve surrounding the second end of said third section and an end of said second section, means for joining said second end of said third section to said sleeve and for joining said end of said second section to said sleeve. third

9. A longitudinally extending percussion tool as defined in claim 3 wherein said tool comprises three tool sections, a first tool section of selected length which includes a working end portion, a second tool section of selected length which includes said impact receiving surface, and a third section of selected length having first and second ends, means for joining a first end of said third section to an end of said second section and for joining a second end of said third end section to an end of said first section for forming a tool of predetermined length L equal to the length of said monolithic tool with impedence mismatches at the L/4 and L/2 points along the length of the tool.

10. A percussion tool as set forth by claim 9 wherein each end of said third section includes a threaded portion, and the respective ends of said first and second sections to which the ends of said third section are joined include threaded portions.

11. A percussion tool as set forth in claim 9 wherein each end of said third section comprises a conically shaped portion, and the end of each of said first and second sections which is joined to said third section includes a conically shaped portion which is dimensioned to interfit with a respective end of said third portion and to provide an interference fit therewith.

12. A percussion tool as set forth in claim 9 wherein each end of said first and second section includes a slot for receiving a respective pin, each associated pin and slot being in shrink fitted engagement.

13. A percussion tool as set forth in claim 9 wherein there is provided a first sleeve surrounding the first end of said third section and an end of said first section, means for joining said first end of said third section to said sleeve, a second sleeve surrounding the second end of said third section and an end of said second section, means for joining said second end of said third section to said sleeve for joining said end of said second section to said sleeve.

* * * * *